US008500845B2

(12) United States Patent
Pizzuto et al.

(10) Patent No.: US 8,500,845 B2
(45) Date of Patent: Aug. 6, 2013

(54) PROCESS FOR REFINING LEAD BULLION

(75) Inventors: Miguel Pizzuto, Terrell, TX (US); Robert Seebeck, Southlake, TX (US); Jerry D. Schulz, Burnsville, MN (US)

(73) Assignee: Stannum Group LLC, Southlake, TX (US)

( * ) Notice: Subject to any disclaimer, the term of this patent is extended or adjusted under 35 U.S.C. 154(b) by 0 days.

(21) Appl. No.: 13/478,404

(22) Filed: May 23, 2012 (Under 37 CFR 1.47)

(65) Prior Publication Data

US 2012/0227544 A1 Sep. 13, 2012

Related U.S. Application Data

(63) Continuation of application No. 12/533,524, filed on Jul. 31, 2009, now Pat. No. 8,211,207, which is a continuation-in-part of application No. 12/228,069, filed on Dec. 5, 2006.

(60) Provisional application No. 60/873,184, filed on Dec. 5, 2006.

(51) Int. Cl.
*C22B 13/00* (2006.01)

(52) U.S. Cl.
USPC ..... 75/697; 75/701; 75/702

(58) Field of Classification Search
USPC ..... 75/697, 701, 702
See application file for complete search history.

(56) References Cited

U.S. PATENT DOCUMENTS

| | | | |
|---|---|---|---|
| 1,395,820 | A | 11/1921 | Harris |
| 1,418,148 | A | 5/1922 | Harris |
| 1,573,830 | A | 2/1926 | Harris |
| 1,756,007 | A | 4/1930 | Perkins et al. |
| 1,779,272 | A | 10/1930 | Heberlein |
| 2,043,575 | A | 6/1936 | Jones et al. |
| 2,067,394 | A | 1/1937 | Hall |
| 2,076,800 | A | 4/1937 | Thummel |
| 2,113,643 | A | 4/1938 | Betterton et al. |
| 3,607,232 | A | 9/1971 | Lebedeff et al. |
| 3,793,004 | A | 2/1974 | Boddey et al. |
| 4,425,160 | A | 1/1984 | Mehta et al. |
| 4,456,231 | A | 6/1984 | Bergsoe |
| 4,911,755 | A | 3/1990 | Larouche |
| 5,053,076 | A | 10/1991 | Burany et al. |
| 5,171,550 | A | 12/1992 | Deininger et al. |
| 5,451,247 | A | 9/1995 | Gross et al. |
| 6,177,056 | B1 | 1/2001 | Prengaman et al. |

FOREIGN PATENT DOCUMENTS

| | | | |
|---|---|---|---|
| JP | 57-005829 | A | 1/1982 |
| JP | 57-026132 | A | 2/1982 |
| JP | 57-057848 | A | 4/1982 |

OTHER PUBLICATIONS

The Feb. 24, 2011 PCT International Search Report for International application No. PCT/US2010/043807.

Cecil E. Bassett, Lead Recycling, 1978, Dallas Texas, pp. i-iii, Table of Contents, pp. 20, pp. 84-98, pp. 105-110, pp. 133-136.

(Continued)

*Primary Examiner* — Weiping Zhu
(74) *Attorney, Agent, or Firm* — Kinney & Lange, P.A.

(57) ABSTRACT

A unique pyrometallurgical lead refining process includes adding a Lewis acid component and an Arrhenius base compound to a molten lead bullion. The Lewis acid component and Arrhenius base compound are added in stoichiometric amounts that preferentially remove lighter amphoteric elements from the molten lead bullion, and promote reactions with amphoteric p-block elements in the lead bullion to form over the lead a slag of Lewis bases, thereby forming a slag layer incorporating the metal salts of the amphoteric p-block elements.

20 Claims, 3 Drawing Sheets

OTHER PUBLICATIONS

Carle R. Hayward, An Outline of Metallurgical Practice, Third Edition, 1955, pp. 196-199.

Carle R. Hayward, Outline of Metallurgical Practice, Fourth Edition, 1955, pp. 194-197.

The Jan. 31, 2012 International Preliminary Report on Patentability for International Application No. PCT/US2010/043807.

PROCESS FOR REFINING LEAD BULLION

CROSS-REFERENCE TO RELATED APPLICATION(S)

This application is a continuation of non-provisional application Ser. No. 12/533,524, which was filed on Jul. 31, 2009, which is a continuation-in-part of non-provisional application Ser. No. 12/228,069, which was filed on Dec. 5, 2006, which claims the benefit of provisional application No. 60/873,184, entitled "Process for Separating and Refining Impurities from the Lead Bullion" filed Dec. 5, 2006.

FIELD OF THE INVENTION

This invention relates to lead refining processes, impurity separation and removal.

BACKGROUND

The metallurgy of lead has been very well researched and developed from Roman times forward. Pyrometallurgical techniques were used in ancient England to refine lead and desired alloys, as disclosed in A Study of Lead Softening, Vineburg, Daryl Geoffrey, Master's Thesis. McGill University, Montreal, Canada (2003). The known art of refining advanced with the advent of the process patented by Henry Harris, et al, in London, England ISD 1922, as disclosed in Harris Process, Jones, T. D., ASARCO, The Wisconsin Engineer Volume 33 Number VII (1929). The "Harris process" used slag composition manipulation during pyrometallurgical processing to selectively remove impure compounds and elements found in lead bullion. The Harris process provides an environment where lead impurities including antimony, arsenic, tin, tellurium, and selenium are oxidized out of the lead by mixing or otherwise contacting the molten lead bullion with mildly oxidizing slags consisting of alkali metal hydroxides and other salts. The oxidizing power of the slag is then enhanced by use of air, or other oxidizing agents, such as alkali hydroxides mixed with alkali nitrates. After the alkali slag is sufficiently laden with impure metal hydroxides and compounds, the slag is decanted or otherwise removed from the lead.

By 1922, The American Smelting and Refining Company ("ASARCO") had adapted the Harris process to use slag as a vehicle for initiating the refining operation at the ASARCO refinery at Perth Amboy, N.J. U.S. Pat. No. 2,113,643 (Betterton, et. al.) details the use of chloride slag mixtures to recover impurities from the refining of lead bullion. Betterton added gaseous chlorine to the molten slag to provide the oxidizing power to drive the impurity level in the slag to optimum levels. While not stated in the Betterton patent, the volatility of the various chlorides, particularly arsenic trichloride requires a gas handling system. Betterton adjusted the composition of the molten slag, consisting of sodium chloride, calcium chloride, magnesium chloride, and potassium chloride to produce a very low meting point. As the slag becomes loaded with impure metal chlorides, the viscosity and melting point change, thus providing the operator with convenient control parameters.

More modern processes include the KIVCET process where slag oxidation/reduction control is accomplished in the furnace rather than in the refining kettles. As the twentieth century drew to a close, costs and environmental considerations changed the complexion of lead refining and alloy production.

Practically speaking, the only waste products that can be economically disposed to the environment are: very low lead content iron/lime/silica blast furnace slags that must pass the EPA TCLP test; very clean alkali salts such as chlorides, sulfates, or carbonates; and very limited amounts of sulfur dioxide (released to the atmosphere). In many cases, the air discharge limits on sulfur dioxide are so low that conversion to marketable commercial sulfate solution or salt is necessary.

The United States secondary lead smelting industry is subject to environmental restrictions regarding discharge levels of lead and other toxic metals. Consequently, the industry uses reagents that have minimal impact on the discharge levels of toxins into the environment. Such reagents include air and oxygen. The use of air or oxygen for lead bullion refining has a very low initial cost. However, the process requires a very hot kettle at 575° C. to 650° C. (1000° F. to 1200° F.), which consumes more fuel and shortens kettle life. The process is slow and the by-product lead oxide containing the antimony, tin, arsenic and other elements consumes eight to twelve percent of the lead in the kettle. Lead loss, added energy costs, and shortened kettle life make the process expensive. In addition, tons of fluffy lead oxide powder forming on top of the refining kettle must be removed manually. This lead oxide by-product is an environmental hazard and as such, is strictly regulated by the EPA and OSHA.

Due largely to the high temperatures involved during conventional refining, a significant amount of antimony is removed from the lead along with other impurities. This can be undesirable in that antimony contributes to the structural strength of the lead alloys, and enhances casting with lead by improving the capacity of the molten lead to fill voids in the molds. Current production processes and practices using air for kettle refining exhibit high energy cost, lead-in-air regulatory compliance issues, long processing times (more than eight hours), and a nominal ten percent loss of product to the recycle loop for every kettle treated.

There is a need to improve the traditional lead refining process and rectify problems associated with impurity separation. There is also a need for more efficient removal of tin and improved retention of antimony when removing other impurities.

SUMMARY

A process for refining lead bullion in accordance with the present disclosure includes maintaining lead bullion at a temperature just above its melting point, removing copper from the bullion, heating the lead bullion to a processing temperature in the range of about 399° C. (750° F.) and about 454° C. (850° F.), maintaining the lead bullion at the processing temperature, adding a Lewis acid component and an Arrhenius base compound to the molten lead bullion in stoichiometric amounts to preferentially remove lighter amphoteric elements from the molten lead bullion, and promote reactions with amphoteric p-block elements in the lead bullion, thereby forming a slag layer incorporating metal salts of the amphoteric p-block elements, and periodically removing at least a majority of the slag layer from the top of the lead bullion.

A lead refining method in accordance with the present disclosure includes heating a lead bullion to a processing temperature between about 399° C. (750° F.) and about 454° C. (850° F.), and adding a Lewis acid component and an Arrhenius base compound to the molten lead bullion in stoichiometric amounts to preferentially remove lighter amphoteric elements from the lead bullion and promote reactions with amphoteric p-block elements thereby forming a slag layer incorporating the metal salts of the amphoteric p-block elements on the lead bullion.

BRIEF DESCRIPTION OF THE DRAWINGS

FIG. 3 is a graph that illustrates selective retention of antimony while separating tin and arsenic with the process of FIG. 1.

DETAILED DESCRIPTION

Figure 1:
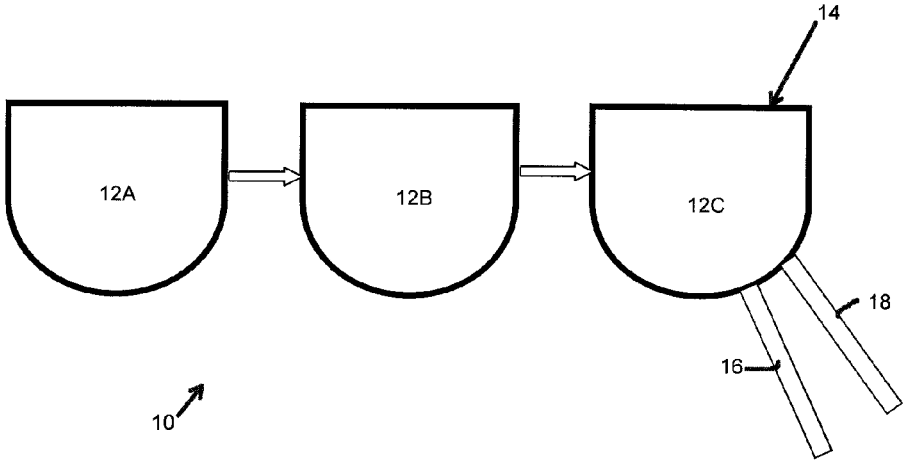
FIG. 1 is schematic representation of a lead refining process in accordance with the present disclosure.

FIG. 1 depicts method or process 10 for pyrometallergically refining lead bullion. Process 10 includes kettle 12 in three stages A, B, and C. Stages A and B are first and second refining processes, respectively, and stage C is a finalized separation process known as the Razor Process™ 14. Also shown in FIG. 1 are lead oxide source 16 and sodium hydroxide source 18 for adding these components to kettle 12, during stage C. It is to be understood that sources 16 and 18 can entail manual or automated feeding approaches.

Refining kettle 12, or any other suitable vessel, typically containing between about 65 and about 120 tons of lead bullion, and includes a top mounted an internal stirring structure (not shown) for forming a vortex of the lead to facilitate a thorough mixing of components added to the lead. Following refining stages A and B, conventional de-tinning and, if desired, softening steps, would traditionally be employed at stage C. The present disclosure, however, provides Razor Process 14 at stage C to be used instead of, or in addition to, conventional de-tinning and/or softening steps.

Stage A refining, or "first dross removal", involves melting the lead bullion and maintaining the molten lead at a temperature just above its melting point (327° C. (620° F.) for pure lead) within kettle 12. This temperature facilitates removal of copper and other impurities from the lead bullion. Copper dross forms a powdery or granular solid and rises to the top of the bullion where it can then be skimmed off. Stage A can be enhanced by adding sulfur, which aids in sulfur compound removal.

After completion of Stage A, Stage B processing occurs. Stage B refining includes residual sulfur removal, along with tellurium and selenium removal, and is accomplished by adding metallic sodium or calcium to the lead bullion, which forms a caustic tellurium slag that can then be skimmed off. Additional reagents can be utilized during Stage B including aluminum, coke breeze, and/or tar, depending upon the refining steps required.

After Stage B, conventional de-tinning would typically be undertaken at stage C. Conventional de-tinning involves heating the lead bullion to between about 593° C. (1100° F.) and about 649° C. (1200° F.), which slowly oxidizes tin out of lead. The thermodynamics are such that anywhere from about 10% to about 14% of the lead in kettle 12C is also oxidized forming a dusty, fine, oxide, which must be removed from the kettle and transported to storage for accumulation prior to re-smelting. The present disclosure provides Razor Process 14 to be employed in kettle 12 at stage C, which prevents the traditional loss of 10-14% lead.

At stage C, Razor Process 14 includes heating the lead bullion to a desired processing temperature between about 399° C. (750° F.) and about 454° C. (850° F.), significantly lower than the temperature of traditional techniques. While maintaining the lead bullion at this processing temperature, a Lewis acid component is provided to kettle 12C. The Lewis acid component may be non-ferrous metal oxide, such as lead oxide, and preferably takes the form of oxide mud, desulfated battery paste, or even conveyor clean up with separators or other cleanup material. Also during Razor Process 14, a component containing an Arrhenius base compound of a light metal hydroxide is added to the kettle 12C. The Arrhenius base may be, for example, sodium hydroxide, calcium hydroxide, or potassium hydroxide.

The Lewis acid and the Arrenius base can be added manually to kettle 12 at stage C (e.g. by shoveling into the vessel). In this case, the components are added intermittently. Alternatively, a conveyor system or other automated approach may be employed, such as lead oxide source 16 and sodium hydroxide source 18. In either event, both the Lewis acid and Arrenius base are provided in amounts equivalent to the stoichiometic amount of tin to be removed by exsolvation and the amount of stannate to be formed. For example, recovering tin can entail adding lead oxide and sodium hydroxide at rates of 1.38 kg (3.7 pounds) and 1.46 kg (3.9 pounds), respectively, for each 0.45 kilogram (pound) of tin recovered. As the Lewis acid and Arrenius base are added to kettle 12C, the molten lead bullion should be agitated to maintain a vortex, thereby insuring a thorough mixing of the components. Thorough mixing promotes reactions with amphoteric p-block elements (impurities) in the lead, which leads to formation of a slag over the lead bullion, where the slag is composed of Lewis bases such as stannate and arsenate.

The reactions of Razor Process 14 are allowed to continue until the concentration of impurities in the slag is greater than 10% of the slag, by weight. Preferably, Razor Process 14 continues until the concentration of impurities in the slag is between about 25% and about 35% of the slag, by weight. At that point, the slag layer is removed and additional stoichiometric amounts of Lewis Acid and Arrhenius Base can be added to kettle 12. The slag is monitored for signs of approaching the concentration limit and component depletion. This point can be recognized by monitoring the thickness and viscosity of the slag layer. For example, in a kettle having a capacity of one hundred tons of lead bullion, it has been found satisfactory to remove the slag whenever the thickness of the slag layer approaches about 5-10 cm (2-4 in). An additional sign that the Lewis acid component is depleted and approaching the limit of the reaction is the formation of sodium stannate indicated by the liberation of hydrogen, which burns at the top of the molten lead and slag layer thereby providing a visual indication.

The combination of a Lewis Acid, a Arrhenius base, and a lower processing temperature afford Razor Process several advantages over conventional refining such as the Harris process. The lower processing temperature of Razor Process can reduce cost by conserving energy and reduces the potential for reverse reaction, thus allowing for process flexibility and reuse of the molten slag. Further, Razor process 14 requires considerably less time than traditional methods of lead refinement. The presently disclosed tin separation process can take about eight hours as compared to about twenty hours for conventional de-tinning. An additional benefit of the Razor Process is that the antimony in kettle 12C can be controlled at will. If softening (antimony removal) is desired, the same procedures employed during the Razor Process 14 for de-tinning can be employed again to remove antimony in the form of sodium and antimonate. Slightly higher temperatures will facilitate this reaction. Additionally or alternatively, conventional softening could be employed, depending on the nature of the refining by-product most advantageous to the plant operations. Other aspects and benefits of Razor process 14 are detailed below.

Figure 2:
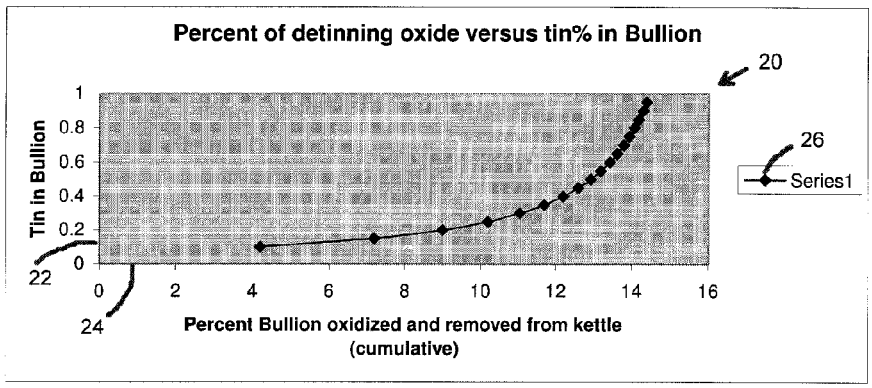
FIG. 2 is a graph that illustrates the amount of lead oxidized and removed during conventional de-tinning.

FIG. 2 is graph 20 illustrating the amount of lead oxidized and removed during conventional de-tinning, such as the Harris process. Y-axis 22 is the amount of tin in the lead bullion and X-axis 24 is the cumulative percent of lead bullion oxidized and removed from the kettle during de-tinning. Line 26 shows the amount of lead loss during conventional antimony at a temperature between about 593° C. (1100° F.) and about 648° C. (1200° F.). Graph 20 is provided to illustrate traditional industry practice where lead loss approaches 14-15% during de-tinning. Traditionally, as the impurity level (e.g. tin, antimony) decreased, the amount of energy, time, and lead metal lost to by-products, increased in an inversely proportional manner. In other words, the smaller the amount of impurity present, the more effort, energy, and lead loss was required to remove the same amount of impurity. This traditional dilemma, however, is bypassed by use of the Razor Process.

Figure 3:
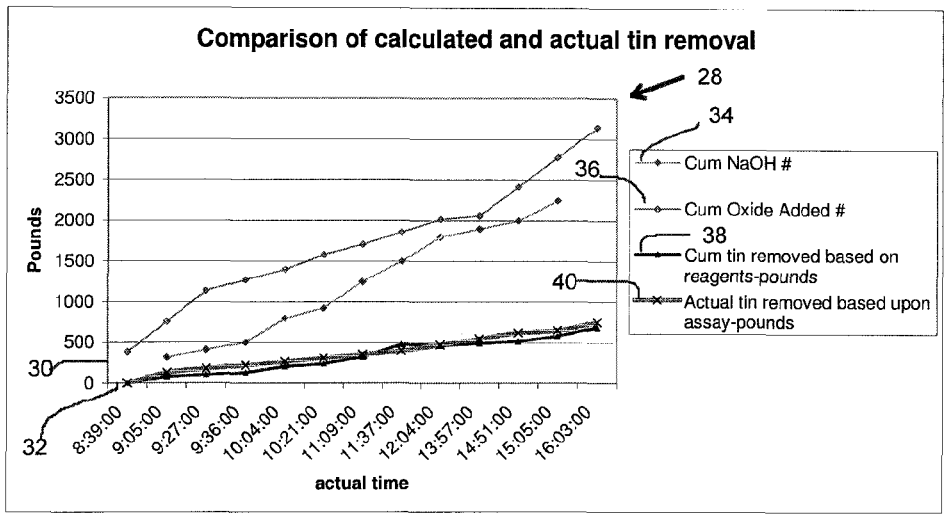
FIG. 3 is a graph that compares calculated versus measured tin separation, as well as illustrates cumulative addition of lead oxide and sodium hydroxide, in accordance with the process of FIG. 1.

FIG. 3 is graph 28 comparing calculated and measured tin removal, as well as illustrating the amount of lead oxide and sodium hydroxide added during the Razor Process. Y-axis 30 is the amount of material in pounds and X-axis is actual time in hours, minutes, and seconds. Line 34 shows the cumulative amount of sodium hydroxide (Arrhenius base) added over time and line 36 shows the amount a lead oxide (Lewis base) added over time. Line 38 represents the cumulative amount of tin that should have been removed from the lead bullion based on predictive calculations, and line 40 represents the cumulative amount of tin actually removed from the lead bullion. As illustrated, the amount of tin actually removed (40) was not significantly different than the amount predicted (38), representing a close agreement between sampling and the calculated result. One of the advantages of the Razor process is its capacity to selectively separate and recover tin (and arsenic) while leaving substantially all of the antimony in the lead. This desirable result stems from lower processing temperature, as well as other factors.

Figure 4:
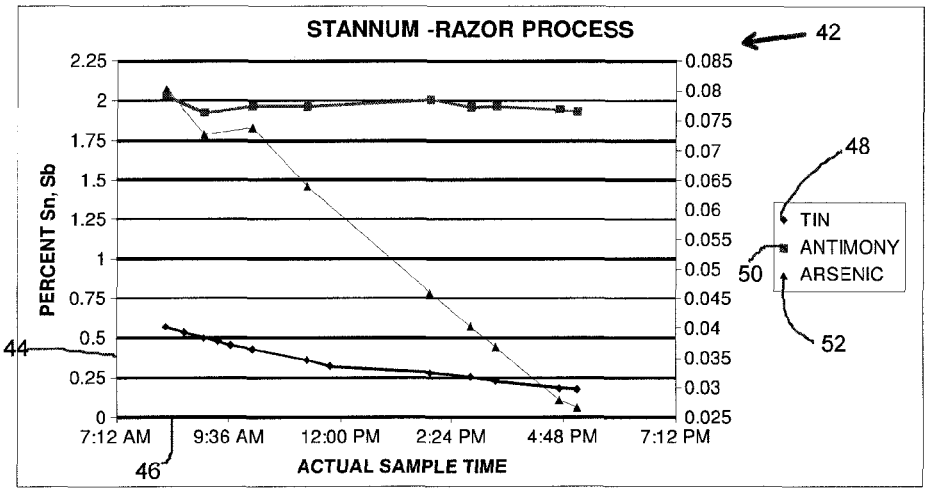
FIG. 4 is a graph that illustrates how an increase in process temperature increases the rate of tin separation for the process of FIG. 1.

FIG. 4 is graph 42 showing selective retention of antimony while separating tin and arsenic according to the Razor process. Y-axis 44 is the amount of material present in the kettle and X-axis 46 is the time in hours and minutes. Line 48 is amount of tin removed over time, line 50 is amount of antimony removed over time, and line 52 is the amount of arsenic removed over time. As illustrated, antimony (see line 50) stays relatively stable, tin (see line 48) decreases, and arsenic (see line 52) decreases dramatically during the Razor process. In other words, the Razor process employs selective purification: tin recovery is enhanced, while antimony remains to provide increased strength and other favorable properties to the refined lead.

Figure 5:
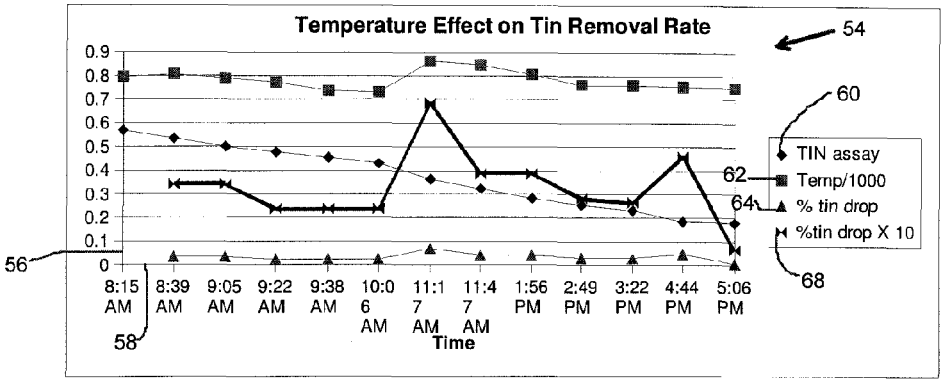
FIG. 5 is a graph that illustrates the gain and cumulative gain of lead during the process of FIG. 1.

FIG. 5 is graph 54 illustrating the effect of temperature on tin removal. Y-axis is temperature and X-axis is time in hours and minutes. Line 60 shows tin removal, line 62 shows temperature divided by 1000, line 64 shows percent of tin removed, and line 68 shows percent of tin removed multiplied by 10. As temperature (62) decreases below 800° F. (time 9:38), the percent of tin removed (best illustrated by line 68) decreases. The converse is also true, as temperature (62) increases above 800° F. (time 11:17), the percent of tin removed (68) increases. Maintaining the lead bullion at a process temperature between about 399° C. (750° F.) and about 454° C. (850° F.) results in a stronger tendency to oxidize tin as compared to antimony. Accordingly, the antimony tends to remain in the lead bullion as the tin is separated with the Razor Process. This selective retention of antimony concentration results in the capability to produce antimonal alloy products for commerce without purchasing additional antimony at premium metal prices.

Figure 6:
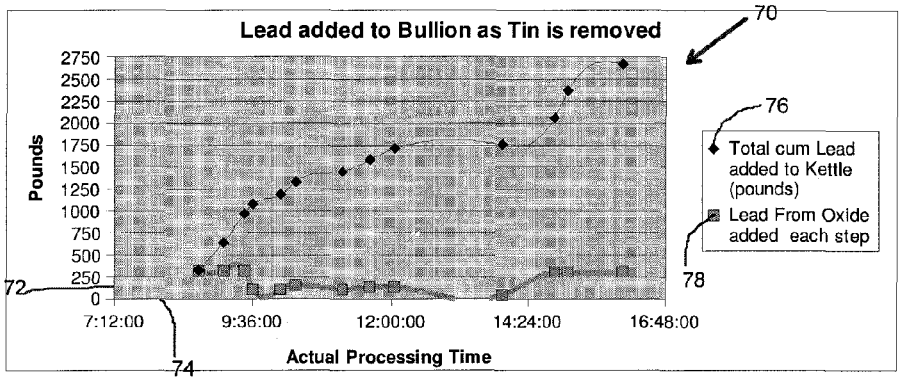

FIG. 6 is graph 70 illustrating the gain and cumulative gain of lead during the Razor process. Y-axis is amount of lead in pounds and X-axis is actual processing time in hours and minutes. Line 76 shows the cumulative amount of lead added to the kettle during refining and line 78 shows the amount of lead added to the kettle from repeatedly adding lead oxide according to the Razor Process. Over time, lead oxide (78) is added to kettle, thereby increasing the total amount of lead (80) present. For example, before the Razor Process a kettle may contain approximately 82 tonnes (90 tons) of lead and after the Razor process the kettle may contain 91 tonnes (100) tons of lead. As discussed at length above, the Razor process includes addition of a Lewis acid, such as lead oxide. The use of various lead oxide components such as plant clean-up, sweeper products, and material like conveyor belt cleanup during refinement has several benefits. These lead oxide components provide a less severe form of oxizing material thus avoiding the "over treatment" problem encountered in the Harris process. Further, use of lead oxide avoids the loss of lead (about ten percent) caused by the conventional de-tinning dross in the Harris process. Instead, adding lead oxide during Razor Process can actually add lead to the kettle such that it contains more lead at the end of a tin separation and recovery process.

In sum, the amount of lead lost during the Razor process is relatively small. Further, the Razor process removes tin without substantially decreasing antimony content (about 98% remains), providing opportunities for subsequent antimony removal. Causitc and lead oxide are added to the kettle to produce sodium antimonate, which can easily be removed as a clean, high antimony dross. That material, when re-smelted, will require no de-tinning to make hard lead alloys. An oxidizer, such as sodium nitrate, can be used to speed the process. The economic advantages of the Razor process include: reduced re-smelting charges for high antimony dust, reduced tin content in antimony dross, a higher net concentration of antimony, and reduced energy costs.

Although the present invention has been described with reference to preferred embodiments, workers skilled in the art will recognize that changes may be made in form and detail without departing from the spirit and scope of the invention.

The invention claimed is:

1. A process for refining lead bullion to separate lead from impurities including amphoteric p-block elements, copper, sulfur, selenium, and tellurium, including:

maintaining lead bullion at a temperature just above its melting point;

removing copper from the bullion, heating the lead bullion to a processing temperature in the range of 750° F. to 850° F.;

maintaining the lead bullion at the processing temperature, adding a Lewis acid component and an Arrhenius base compound to the molten lead bullion in stoichiometric amounts to preferentially remove lighter amphoteric elements from the molten lead bullion, to promote reactions with amphoteric p-block elements in the lead bullion to form over the lead bullion a slag of Lewis bases, thereby forming a slag layer incorporating the metal salts of the amphoteric p-block elements; and periodically removing at least a majority of the slag layer from the top of the lead.

2. The process of claim 1 wherein the Lewis acid component comprises a non-ferrous metal oxide.

3. The process of claim 2, wherein the non-ferrous metal oxide comprises lead oxide.

4. The process of claim 1, wherein the Arrhenius base compound comprises a light metal hydroxide.

5. The process of claim 4, wherein the light metal hydroxide is sodium hydroxide.

6. The process of claim 4, wherein the light metal hydroxide is calcium hydroxide.

7. The process of claim 4, wherein the light metal hydroxide is potassium hydroxide.

8. The process of claim 1 further comprising:

removing sulfur, selenium, and tellurium from the bullion.

9. The process of claim 1 further comprising:

agitating the lead bullion during addition of the Lewis acid component and Arrhenius base compound.

10. The process of claim 1, wherein an amount of lead bullion present after adding a Lewis acid component and an Arrhenius base compound is greater than an amount of lead bullion present before adding a Lewis acid component and an Arrhenius base compound.

11. A lead refining method comprising:

heating a lead bullion having impurities including amphoteric elements p-block elements, copper, sulfur, selenium, and tellurium to a processing temperature between about 750° F. and about 850° F.; and adding a Lewis acid component and an Arrhenius base compound to the molten lead bullion in stoichiometric amounts to preferentially remove lighter amphoteric elements from the lead bullion and promote reactions with amphoteric p-block elements thereby forming a slag layer incorporating the metal salts of the amphoteric p-block elements on the lead bullion.

12. The lead refining method of claim 11, further comprising:

removing at least a portion of the slag layer from the lead bullion.

13. The lead refining method of claim 11, further comprising:

maintaining lead bullion at a temperature just above its melting point; and removing copper from the lead bullion prior heating the lead bullion to the processing temperature.

14. The method of claim 11, wherein the Lewis acid component comprises a non-ferrous metal oxide.

15. The method of claim 14, wherein the non-ferrous metal oxide comprises lead oxide.

16. The method of claim 11, wherein the Arrhenius base compound comprises a light metal hydroxide.

17. The method of claim 16, wherein the light metal hydroxide is selected from the group consisting of sodium hydroxide, calcium hydroxide, and potassium hydroxide.

18. The method of claim 11, further comprising:

removing sulfur, selenium, and tellurium from the lead bullion.

19. The method of claim 11, further comprising:

agitating the lead bullion during addition of the Lewis acid component and Arrhenius base compound.

20. The method of claim 11, wherein less than 10% of the lead bullion is oxidized.

* * * * *